United States Patent [19]

Best et al.

[11] 4,411,475

[45] Oct. 25, 1983

[54] CUTTING DRUM

[75] Inventors: Gerd Best, Sprockhoevel; Norbert B. Weikert, Dortmund, both of Fed. Rep. of Germany

[73] Assignee: Krampe & Co. Fertifung in Bergbaubedarf GmbH, Hamm, Fed. Rep. of Germany

[21] Appl. No.: 193,165

[22] Filed: Oct. 2, 1980

[51] Int. Cl.[3] ..... E21C 25/10

[52] U.S. Cl. ..... 299/81; 299/87

[58] Field of Search ..... 299/23, 81, 87, 90, 299/53, 54, 89

[56] References Cited

U.S. PATENT DOCUMENTS

| | | | |
|---|---|---|---|
| 4,219,239 | 8/1980 | Weikert | 299/90 |
| 4,249,779 | 2/1981 | Best et al. | 299/87 |
| 4,273,383 | 6/1981 | Ovisebach | 299/23 |

FOREIGN PATENT DOCUMENTS

| | | | |
|---|---|---|---|
| 2647171 | 5/1978 | Fed. Rep. of Germany | 299/87 |
| 56521 | 12/1968 | Poland | 299/43 |
| 2000539 | 1/1979 | United Kingdom | 299/87 |
| 2027773 | 2/1980 | United Kingdom | 299/87 |
| 2034375 | 6/1980 | United Kingdom | 299/87 |

*Primary Examiner*—William F. Pate, III

*Attorney, Agent, or Firm*—Michael J. Striker

[57] ABSTRACT

A cutting drum for an extracting machine is assembled of a base body having a frustoconical configuration and of an end ring which is detachably mounted to the major end face of the base body. The jacket surfaces of the end ring and of the base body have the same slope so that no jump will result in the separation plane. The connecting means are in the form of radial flanges connected by bolts and provided with centering elements.

5 Claims, 2 Drawing Figures

CUTTING DRUM

BACKGROUND OF THE INVENTION

Cutting drums for extracting machines used in mining are known from prior art. Herein, a frustoconical end ring is integrally joined by welds to the cylindrically shaped base body. An external step will thus result at the transition from base body to the end ring. This will cause a kind of jumping effect when extracting minerals, since the minerals must overcome this step. Particularly when extracting hard coal, a not inconsiderable quantity of minerals will be reduced to dust in an undesirable manner. Furthermore, this will cause interference in the flow of material. Finally, the end ring is subjected to very strong wear in the zone of the steplike transition from base body to the frustoconical end ring. It thus becomes necessary that the cutting drums must, from time to time, be transported above ground and sent to the manufacturer where the end rings will either be refurbished by deposition welding, should this still appear possible, or the worn-out end rings must be flame-cut and a new conical ring be welded onto the base body thereafter. These procedures are linked to considerable expenditure and to stoppages, and thus to a not inconsiderable interruption in production.

These disadvantages are not obviated even by a cylindrical construction of the end ring, while the base body is conically tapering away from the cutting face, as disclosed for example in GB Letters Patent No. 985 678.

SUMMARY OF THE INVENTION

The invention is based on designing a cutting drum of the aforedescribed type in such a manner, that wear in the zone of transition from the end ring to the base body may be kept small, that, in case of need, replacement of the conical end ring may be accomplished with less problems, and that a suitable flow of material along the cutting drum is obtained.

In the cutting drum as per invention, the outer jacket surface of the base body which is of conical shape over its entire length, will continuously transit to the outer, frustoconical jacket surface of the end ring without forming a step or angle. Thus, no jumping effect will occur when extracting minerals by using a cutting drum as per invention. The minerals, hard coal in particular, are thus handled in a more preserving manner and additional generation of dust is avoided.

Furthermore, with a cutting drum as per invention, a particularly good continuous flow of minerals will result during their relative movement from the cutting face over the frustoconical end ring to the base body, and from there to the discharge end of the cutting drum.

The fact that the frustoconical end ring is removably and replaceably fastened to the conical base body, will make it possible that worn end rings may be replaced in situ, relatively problem-free and fast. Thus it is no longer necessary that—as heretofore—the cutting drums must be transported above ground where the conical end rings are to be flame-cut from the base body, and the respective cutting drum refurbished by welding-on of a new end ring, or the worn end rings are repaired by deposition welding.

Furthermore, it will readily be possible by applying the invention to fabricate the frustoconical end ring and the frustoconical base body from one piece of conical tubing, since both parts are of the same taper. The conical end ring may be obtained by cutting it from tubing that is conical overall, for instance by sawing or flame cutting.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
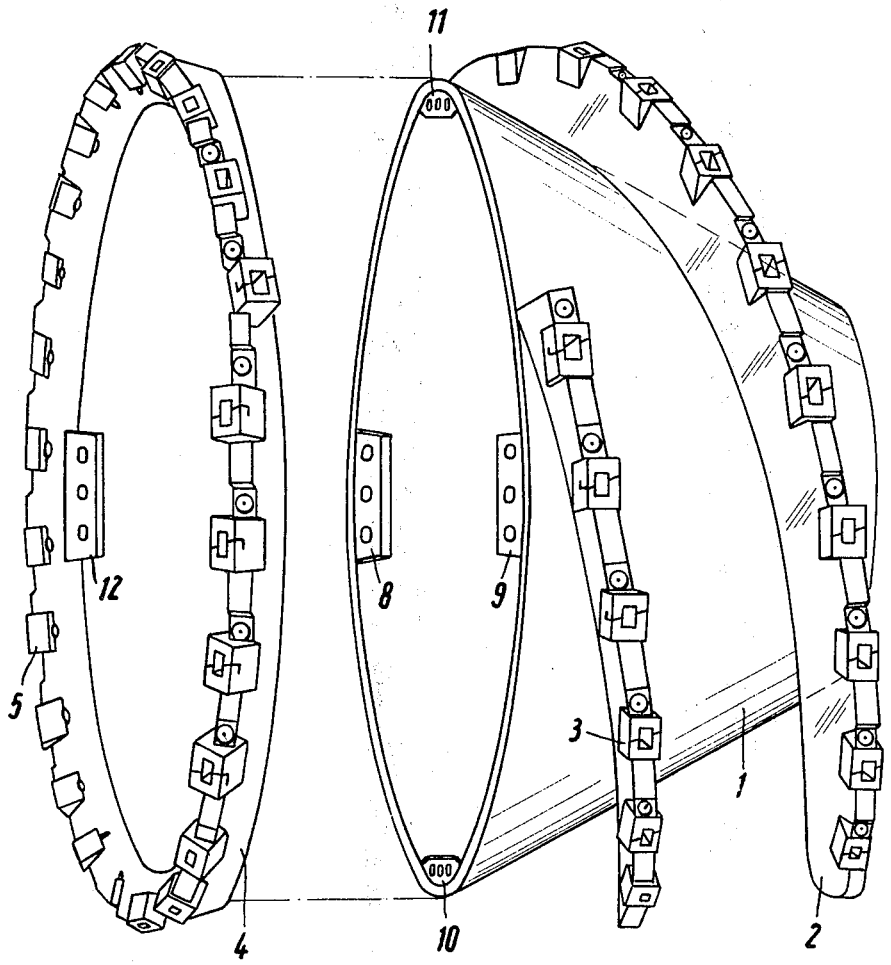
FIG. 1 is an exploded perspective view of a cutting drum of this invention.

Reference numeral 1 denotes a tubular base body, of a conical or frustoconical configuration, wherein the jacket 6 is tapering from the face of working, now shown, toward the discharge side of the cutting drum. In the embodiment shown, the cutting drum is shown in a single spiral design, i.e. the base body 1 is provided with only one spiral 2. This spiral 2 is fabricated from a metallic sheet set edgewise upon the jacket 6 of the base body 1. The spiral 2 is provided along its outer periphery with tool holders 3 uniformly spaced relative to each other and fixedly joined to the spiral 2 by welds not identified in detail. Outward projecting cutting bits, also called picks, are located in the tool holders 3.

Reference numeral 4 denotes a frustoconical end ring oriented toward the face of working. The end ring 4 is provided along its periphery with a plurality of tool holders 5 for accommodating picks, not shown.

Figure 2:
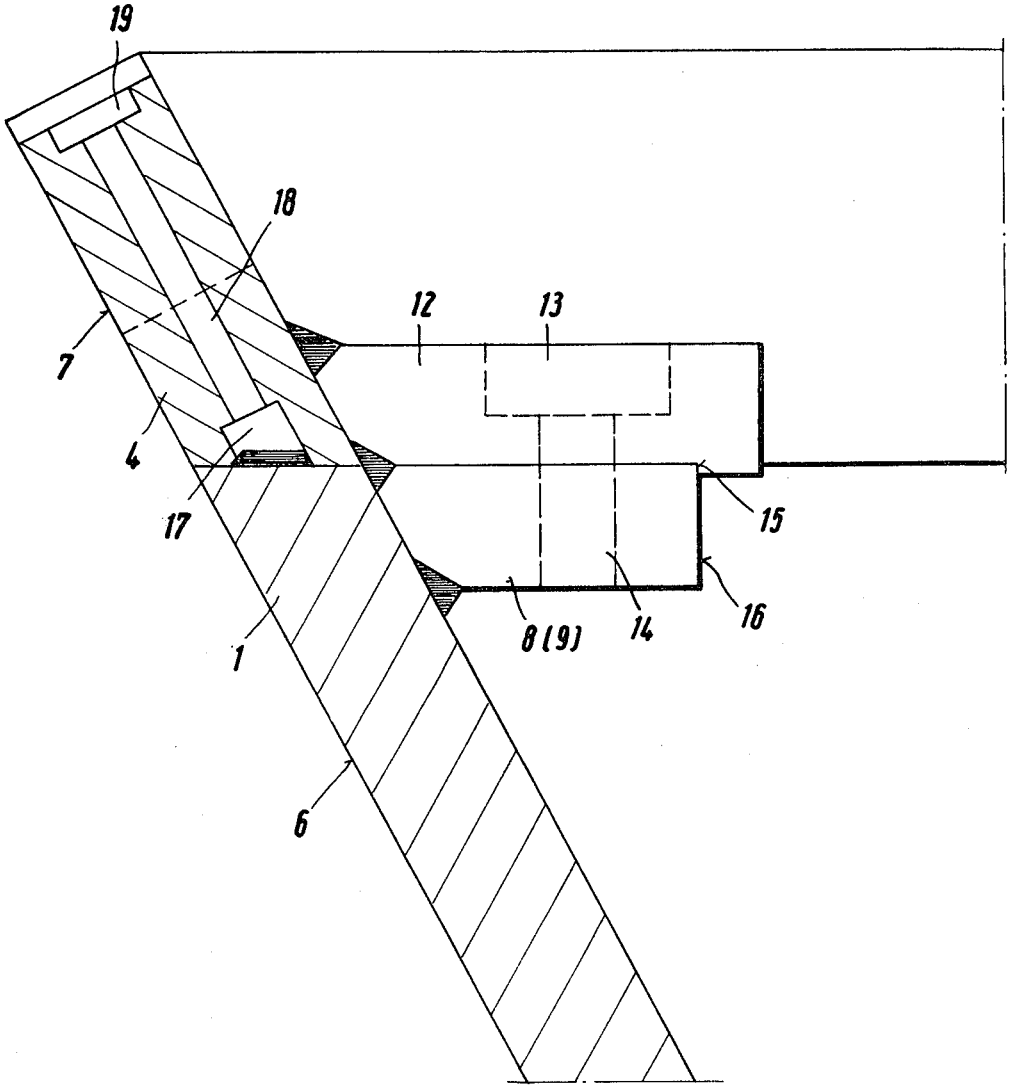
FIG. 2 is a partial sectional side view, shown on an enlarged scale, of the cutting drum of FIG. 1.

As can be seen particularly from FIG. 2, the taper or slope of the jacket of base body 1 and of the jacket of end ring 4 is identical As a result, when the minor annular face of the end ring 4 is connected to the major annular face of the base body 1, the respective jacket surfaces 6 and 7 of base body 1 and of end ring 4, will continuously transit into each other without steps so that the extraced minerals are fed between the windings of spiral 2 and toward the discharge side of the cutting drum without having to overcome a jump or a step.

In their interior, the tubular base body 1 as well as the end ring 4 are provided with a plurality of mounting flanges, four flanges 8, 9, 10 and 11 of the base body 1 are visible in FIG. 1. The end ring 4 is provided with appropriate counter flanges, of which merely one counter flange 12 can be seen in FIGS. 1 and 2. All flanges 8 to 12 are provided with a plurality of through bores 13 and 14 Fastening bolts, not shown, extend through these bores for detachably fastening the end ring 4 to the base body 1. These fastening bolts serve concomitantly for retaining of an end cover, not shown, which forms a sealing closure for the side of end ring 4 which is open toward the face of working.

The flanges and counter flanges 9 to 12, are provided with centering means shown in FIG. 2 in the form of a hook-shaped nose 15 of counter flange 12, said nose reaching over the end side 16 of flange 8. The minor base of end ring 4 can therefore, in any event, be attached to the conical base body 1 only when the two parts are centered. The cover for closing the open side of the end ring 4, only in this centered position when the flanges and counterflanges are in register.

In the embodiment shown, all flanges and counter flanges are integrally joined by welds to the assigned inner walls of the base body 1 and the end ring 4. The same effect may also be achieved by means of circular segments or encompassing circles which—like the flanges and counter flanges—are also provided with aligned through bores and, with the fastening bolts extending through the through bores.

Reference numeral 17 denotes a water manifold from which the spraying water, via a line 18, will reach the orifice of the only schematically indicated nozzle 19. The water passage for the end ring 4 is thus in its entirety located within the wall of the end ring.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cutting drum for an extracting machine as used in mining, comprising a base body having a conical or frustoconical jacket and a major annular face, at least one spiral member wound about the jacket and projecting away therefrom, a first set of cutting tools secured to said spiral member, an end ring having a frustoconical jacket, a major annular face and a minor annular face, the circumference of said minor annular face corresponding to the circumference of the major annular face of said base body and the slope of the jacket of said end ring corresponding to the slope of the jacket of said base body, a second set of cutting tools secured to said end ring, and means for detachably connecting the minor annular face of said end ring to the major annular face of said base body.

2. A cutting drum as defined in claim 1, wherein said connecting means are arranged for the attachment of an end cover in said end ring.

3. A cutting drum as defined in claim 1, wherein said connecting means include connecting members secured to said end ring and opposite connecting members secured to said base body, and centering elements arranged on said connecting members to effect centering of the end ring relative to the base body.

4. A cutting drum as defined in claim 3, wherein said connecting members include a plurality of flanges arranged in the interior of the base body and of the end ring, said flanges being provided with throughbores for receiving fastening means when said centering elements are in register with each other.

5. A cutting drum as defined in claim 1, wherein the major annular face of the end ring is formed with a plurality of nozzles connected respectively to a water manifold formed in the jacket of said end ring.

* * * * *